United States Patent [19]

Isaka et al.

[11] Patent Number: 4,727,834

[45] Date of Patent: Mar. 1, 1988

[54] VERTICAL ENGINE FOR WALK BEHIND LAWN MOWER

[75] Inventors: Yoshiharu Isaka; Kiyohiko Oguri, both of Iwata, Japan

[73] Assignee: Yamaha Hatsudoki Kabushiki Kaisha, Japan

[21] Appl. No.: 60,068

[22] Filed: Jun. 9, 1987

[51] Int. Cl.[4] ..... F01M 1/00

[52] U.S. Cl. ..... 123/196 W; 123/196 CP; 184/6.18; 184/13.1

[58] Field of Search ..... 123/196 W, 196 CP, 179 SE; 184/11.1, 13.1, 6.18

[56] References Cited

U.S. PATENT DOCUMENTS

| | | | |
|---|---|---|---|
| 3,931,812 | 1/1976 | Ashfield et al. | 123/196 CP |
| 4,426,964 | 1/1984 | Umeda et al. | 184/13.1 |
| 4,470,389 | 9/1984 | Mitadera et al. | 123/196 CP |
| 4,570,584 | 2/1986 | Uetsuji et al. | 123/179 SE |
| 4,579,092 | 4/1986 | Kandler | 123/196 CP |
| 4,628,878 | 12/1986 | Nakano et al. | 184/11.1 |

FOREIGN PATENT DOCUMENTS

| | | |
|---|---|---|
| 0041056 | 5/1981 | Japan . |
| 0145209 | 9/1985 | Japan . |
| 0116054 | 6/1986 | Japan . |
| 0210230 | 9/1986 | Japan . |

*Primary Examiner*—E. Rollins Cross
*Attorney, Agent, or Firm*—Ernest A. Beutler

[57] ABSTRACT

A lawn mower or other similar walk behind type of implement that is designed to be operated in a normally erect position and which is tilted to its side for servicing. An engine is provided for the lawn mower having an output shaft rotatable about a vertically extending axis. The engine includes a lubricating system incorporating a crankcase in which the engine output shaft rotates and a crankcase ventilating system. The crankcase ventilating system is designed so as to prevent lubricant from flowing into the induction system when the engine is tilted on its side.

29 Claims, 8 Drawing Figures

VERTICAL ENGINE FOR WALK BEHIND LAWN MOWER

BACKGROUND OF THE INVENTION

This invention relates to a vertical engine for driving an implement such as walk behind lawn mower and more particularly to an improved lubricating system and component layout for such an engine.

A wide variety of implements are driven by small displacement internal combustion engines that are normally mounted on the implement in such a way that the output shaft of the engine rotates about a generally vertically extending axis. The walk behind type of lawn mower is a typical example of an implement that is driven by an engine disposed in such an orientation. Of course, the engine is provided with a lubricating system which includes a lubricate reservoir that is formed within the crankcase chamber of the engine. In order to reduce the emissions of unwanted gases to the atmosphere, it has been the practice to provide even such small engines with closed crankcase venilating systems. With such systems, the blow by gases of the crankcase are returned to the chamber of the engine for further combustion by a crankcase ventilating system that recycles these crankcase gases back to the engine induction system normally through the air cleaner of the engine.

Although the engine is normally operated with its crankshaft rotating about a vertically extending axis, it is quite common with certain types of implements such as the walk behind lawn mower, for the operator to stop the engine and turn the implement onto its side for servicing such as to remove grass which may have clogged the outlet of the lawn mower. When the engine is turned on its side, the lubricant can flow into the induction systems through the crankcase ventilation system. This has a number of disadvantages. In the first instance, there may be developed hydraulic lock in the cylinder that can make starting difficult and can, in fact, damage the engine. Alternatively, the lubricant may be depleted from the crankcase sufficiently so that the engine is not adequately lubricated on restarting. In any event, this flow of lubricant back into the induction can be messy at best.

It is, therefore, a principal object to this invention to provide an improved lubricating and crankcase ventilating system for a small engine that is designed to drive an implement that can be tilted to its side for servicing.

It is a further object of this invention to provide an improved lubricating and crankcase ventilating system for an engine which will preclude the flow of lubricant from the crankcase into the engine induction system regardless of the disposition of the engine.

It is another object of this invention to provide an improved lubricating and crankcase ventilating systm for an engine that will preclude the flow of lubricant into the engine induction system when the engine is being serviced.

With engines having crankcase ventilating systems of the type described, it is desirable, if not essential, to provide a system wherein lubricant can be separated from the crankcase gases and returned to the crankcase. The recycled crankcase gases will contain large amounts of lubricant due to the fact that the lubricant exists to a large extent in a vapor state within the crankcase during the engine running. Therefore, it is a common practice to provide some form of lubricant separator within the crankcase ventilation system that returns the lubricant to the crankcase. However, such lubricant separators also present the problem that they may in fact cause lubricant to flow from the crankcase to the induction system when the engine is shifted to a non-normal condition during servicing of the associated implement.

It is, therefore, a still further object of this invention to provide a lubricant recovery system for a crankcase ventilating system of an engine that will preclude against the flow lubricant into the engine induction system when the engine is disposed in a non-normal position.

In connection with the formation of the crankcase ventilation system and the oil return from that system back to the crankcase, it is normally the practice to form at least a portion of the conduits from separate pipes that must be assembled into the engine. The use of such separate piping not only adds to the cost of the engine but also introduces the possibilities that the piping may interfere with the components of the engine, such as the crankshaft, which rotate within the crankcase.

It is, therefore, a still further object of this invention to provide an improved and simplified conduit system for the crankcase ventilation system of an internal combustion engine.

It is yet another object of this invention to provide an oil return conduit for a crankcase ventilating system that is formed within a wall of the engine and hence which will not interfere with the running components of the engine nor will it require the use of separate pipes.

As should be readily apparent that engines of the type which have been discussed should be very simple so as to maintain low cost and easy serviceability. However, it is also essential that the engine provide a relatively good output in relation to its displacement so as to permit the use of small engines for driving the implements. However, it is also important that all of the components be adequately lubricated. In order to achieve the aforenoted effects, it has been the normal practice to employ some form of splash type lubricating system for this type of engine. In that the engine is disposed with its output shaft rotating about a vertically disposed axis, it is desirable that the camshaft of the engine also be rotatably journaled about a parallel, vertically disposed axis. Such an orientation permits simplicity in the driving arrangement for the camshaft. However, the vertical orientation makes it difficult to insure that the camshaft is adequately lubricated by splash systems.

It is, therefore, a still further object of this invention to provide an improved splash type of lubricating system for an engine having vertically disposed crankshafts and camshafts.

It is a further object of this invention to provide an improved simplified oil slinger arrangement for lubricating the upper bearing of a vertically disposed camshaft for an engine of this general type.

In connection with engines of the type which have been previously discussed, it is also essential that the auxiliaries for the engines such as the carburetor, air cleaner and muffler be disposed in such a way that the engine will be compact and yet these devices can serve their intended functions. Furthermore, it is essential that the components be laid out in such a way that they do not interfere with the cooling of the engine and, in fact, that these components receive the necessary amount of cooling air themselves.

It is, therefore, a still further object of this invention to provide an improved component layout for an internal combustion engine for powering implements.

It is yet another object of this invention to provide an improved component arrangement and cooling system for an engine of this type.

SUMMARY OF THE INVENTION

A number of features of the invention are adapted to be embodied in a lubricating system for an internal combustion engine that is adapted to power an implement such as a lawn mower that is operated normally in an erect position but which is tiltable on its side to a service position. The engine comprises a crankcase defining a crankcase chamber in which an engine output shaft is journaled for rotation about a generally vertically extending axis when the associated implement in is in its normal operating position. The crankcase defines a reservoir for engine lubricant. An induction system is incorporated for providing combustion air to the engine and includes an air inlet device for receiving atmospheric air for the delivery to the engine. The engine also includes a crankcase ventilating system for the crankcase chamber that comprises a crankcase air inlet for receiving gases from the crankcase and conduit means extending from the crankcase air inlet to the air inlet device for recirculating crankcase gases to the engine through its induction system.

In accordance with a first feature of the invention, the crankcase air inlet lies above the level of lubricant in the crankcase regardless of whether the associate implement is in its normal or service positions for precluding lubricant from flowing into the air inlet device.

In accordance with other features of the invention, a lubricant return conduit extends from the conduit means back to the crankcase for returning separated lubricant from the recycled crankcase gases back to the crankcase. The lubricant return conduit has a lubricant inlet opening communicating with the conduit means and a lubricant return opening communication with the crankcase. In accordance with one feature of the invention, at least one of the openings is disposed above the level of lubricant in the crankcase when the implement is in its service position.

In accordance with another feature of the invention, the lubricant return conduit is formed in a wall of the engine.

Yet another feature of the invention is adapted to be embodied in a lubricating system for an internal combustion engine having a generally horizontally disposed cylinder extending from a crankcase. A crankshaft is journaled for rotation within the crankcase about a generally vertically extending axis and a camshaft is also is journaled for rotation within the crankcase about a vertically disposed axis. Means are incorporated for driving the camshaft from the crankshaft. An oil slinger is rotatable about an axis that is disposed at an angle to both the horizontal and vertical and is at least in part submerged in the lubricant in the crankcase. Drive means drive the oils linger from the camshaft. The oil slinger axis is disposed for directing lubricant thrown by the slinger toward the upper end of the camshaft for lubricating its upper support bearing.

Another feature of the invention is adapted to be embodied in an internal combustion engine of the type for powering an implement with the engine output shaft rotating about a generally vertically disposed axis. A cylinder is disposed in a generally horizontal plane and an induction system comprised of the carburetor lies on one side of the cylinder for delivering a charge to the cylinder from that one side. An air cleaner is disposed above the carburetor on the one engine side for delivering filtered air to the carburetor. An exhaust system including a muffler is disposed on a side of the cylinder opposite to the air cleaner for discharging exhaust gases from the cylinder to the atmosphere. A fan chamber is disposed above the cylinder and contains a fan driven by the engine. Means define a flow path through the fan chamber between a cooling air inlet disposal contiguous to the air cleaner and a discharged disposed contiguous to the muffler for cooling the engine.

DETAILED DESCRIPTION OF THE PREFERRED EMBODIMENT OF THE INVENTION

Figure 1:
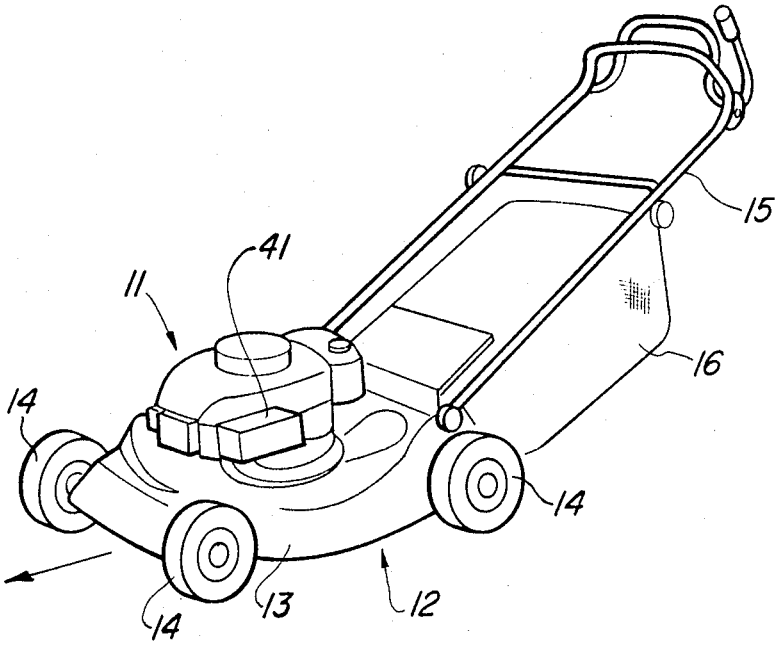
FIG. 1 is a perspective view showing a walk behind lawn mower powered by an internal combustion engine constructed in accordance with an embodiment of the invention.

Referring first to FIG. 1, a typical application for an internal combustion engine constructed in accordance with an embodiment of the invention is illustrated. In this illustrated embodiment, an internal combustion engine, indicated generally by the reference numeral 11, is employed for powering a walk behind lawn mower of the rotary type, which lawn mower is identified generally by the referenced numeral 12. The lawn mower 12 includes a main housing portion 13 that is supported on wheels 14 and which has a rearwardly disposed handle 15 so that an operator may maneuver the lawn mower 12 and push it forwardly if the lawn mower is not of the self propelled type. Contained within the housing 12 is a rotary blade which cuts grass and directs it rearwardly through a discharge opening into a catcher bag 16 as is well known in this art. Since the construction of the lawn mower 12 forms no part of the invention, further details of its construction are believed unnecessary.

However, in addition to being operated in the normal position as shown in FIG. 1, frequently the lawn mower 12 will be tilted to one side or the other by an operator to service it by removing grass which may clog the discharge opening and prevent entry into the catcher bag 16.

Also it is to be understood that although the invention is disclosed in conjunction with a walk behind type of lawn mower, the invention may be utilized in conjunction with a wide variety of other implements. However, the invention has particular utility in connection with applications where in the engine has its output shaft normally rotating about a vertically disposed axis but wherein the engine may be tilted from this disposition to one in which the output shaft is disposed in a generally horizontal plane during servicing of the implement.

Referring now to the construction of the engine and primarily to the remaining figures, the engine 11 is depicted as being of the single cylinder type and includes a cylinder block 17 that is formed with a horizontally disposed cylinder bore 18. It should be noted that when horizontal or vertical dispositions are referred to herein, these referred to the normal planes. Cylinder 17 extends from a crankcase assembly, indicated generally by the referenced numeral 19. Crankcase 19 is formed generally from a main casting which may be integrally formed with the cylinder 17.

In addition, a lower cover plate 21 is affixed to the main crankcase portion 19 in a known manner so as to provide a closed crankcase chamber 22. Rotatably journaled within the crankcase chamber 22 is a crankshaft indicated generally by the referenced numeral 23. The crankshaft 23 is journaled by an upper bearing 24 and a lower bearing 25 which bearings formed in the main crankcase portion 19 and the cover plate 21, respectively.

A piston 26 is slideably supported within the cylinder bore 18 and is connected to the upper end of a connecting rod 27 by means of a piston pin 28. The connecting rod 27 has a big end 29 that is journaled on a surface the crankshaft 23 for driving the crankshaft upon reciprocation of the piston 26, as is well known.

A cylinder head 31 is affixed in a known manner to the cylinder 17 and forms a closure for the upper end of the cylinder bore 18. The cylinder head 31 is formed with a recess 32 that cooperates with the head of the piston 26 and cylinder bore 18 to define the combustion chamber.

An induction system is incorporated for delivering a combustible fuel air mixture to the combustion chamber 32. This induction passage includes an intake passage 33 that is formed in the cylinder head 31 and which receives a fuel air charge from a carburetor, indicated generally by the referenced numeral 34 and which may be of any known type. In the illustrated embodiment, the carburetor 34 is of the side draft type and is disposed at one side of the cylinder 17. An intake pipe 35 is connected to the air horn of be carburetor 34 and extends to an air inlet device in the form of an air cleaner 36 that is disposed vertically above the carburetor 34 to the same side of the cylinder 17 as the carburetor 34. As a result, a compact arrangement is provided and the air cleaner 36 is disposed at the upper end of the engine so that its filter element can be conveniently serviced.

The intake passage 33 of the cylinder head 31 terminates at an inake port 37 formed in the cylinder head 31. An intake valve 38 is slideably supported within the cylinder head 31 in a known manner and is operated in a means to be described so as to sequentially open and close the intake port 37 and permit an intake charge to flow from the carburetor 34 into the combustion chamber 32.

An exhaust passage 39 extends through the side of the cylinder head 31 opposite to the side in which the intake passage is formed. At its outer end, the exhaust passage 39 communicates with a muffler 41 that is affixed to the cylinder head 31 on the side opposite to the carburetor 34. As a result, the muffler 41 will be disposed clear of the inlet side of the engine and can freely discharge the exhaust gases to the atmosphere through an appropriate outlet.

An exhaust port 42 is formed in the cylinder head 31 at the termination of the exhaust passage 31. An exhaust valve 43 is slideably supported within the cylinder head 31 and controls the flow through the exhaust port 42.

Figure 8:
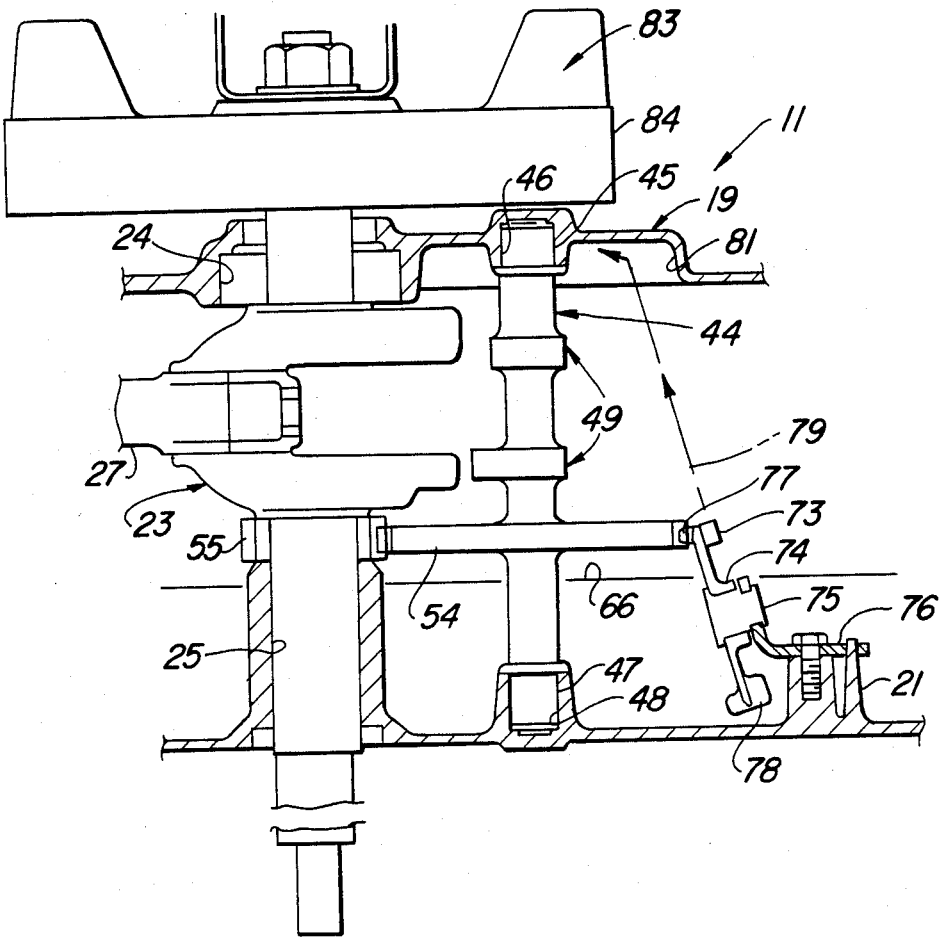
FIG. 8 is a cross sectional view, on an enlarged scale, taken generally along the line 8—8 of FIG. 2.

The mechanism for operating the intake valve 38 and exhaust valve 43 includes a camshaft, indicated generally by the reference numeral 44 and shown in most detail in FIG. 8. The camshaft 44 has an upper bearing portion 45 that is journaled within a bearing 46 formed in the crankcase 19. The lower end of the camshaft 44 is formed with a bearing portion 47 that is journaled within a bearing 48 formed in the lower cover portion 21. The camshaft 44 is journaled for rotation about a vertically disposed axis that is parallel to the axis of rotation of the crankshaft 23 but which is offset to one side of it.

The camshaft 44 is provided with a pair of spaced cam lobes 49 that operate slideably supported tapets 51 and push rods 52 (FIG. 2) that extends through the cylinder 17 on the exhaust side of the cylinder bore 18. The push rods 52 cooperate with pivotedly supported rocket arms 53 for operating the intake and exhaust valves 38 and 43 in a known manner.

The camshaft 44 is formed within an integral cam gear 54 that is in mesh with a timing gear 55 that is either affixed to or formed integrally with the crankshaft 23. The ratio between the gears 54 and 55 is such that the camshaft 49 is driven at one half crank shaft speed, as is well known in the four cycle internal combustion engine field.

Figure 5:
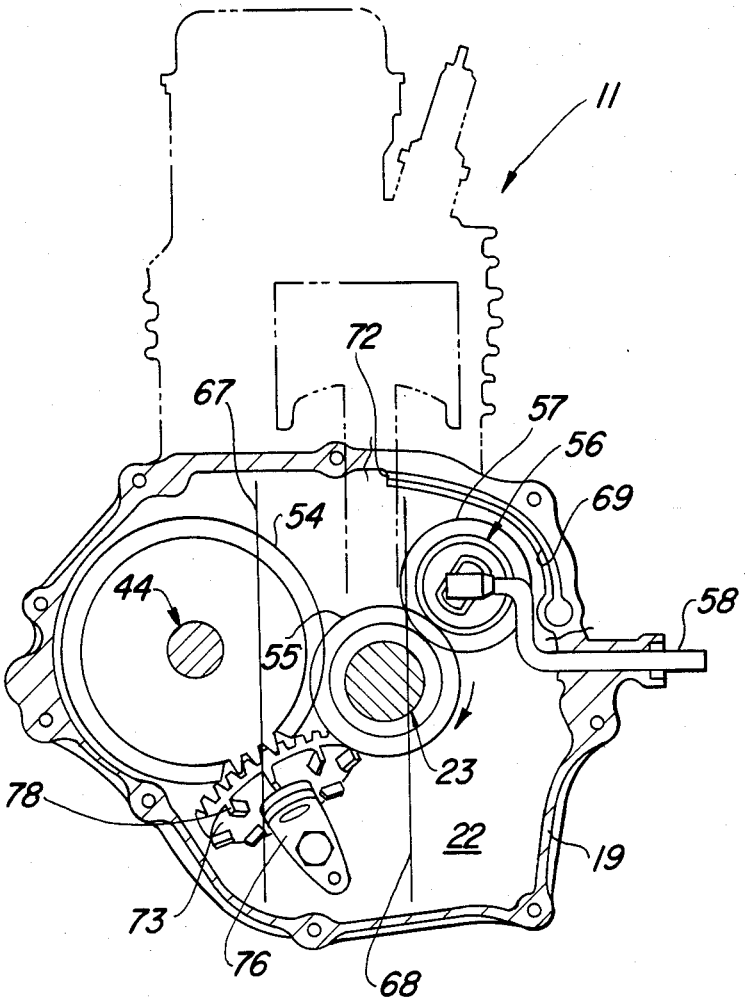
FIG. 5 is a cross sectional view taken along the line 5—5 of FIG. 4.

Also contained within the crankcase cavity 22 is a governor mechanism, indicated generally by the reference numeral 56 (FIG. 5). The governor mechanism 56 has a shaft to which a gear 57 is affixed. The gear 57 meshes with the crankshaft timing gear 55 so as to drive the governor mechanism. A governor shaft 58 is connected to the throttle linkage of the engine for maintaining a set engine speed as determined by the operator, as is well known in this art. Since the governor mechanism 56 may take any known configuration, a further description is believed to be unnecessary.

Figure 6:
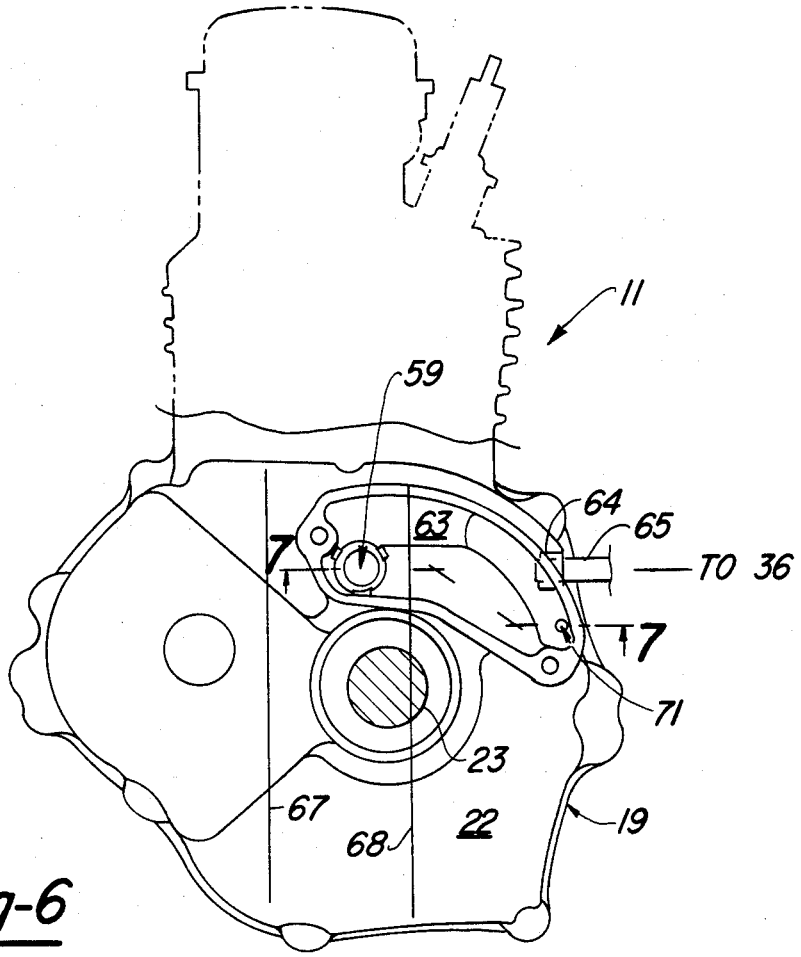
FIG. 6 is a cross sectional view taken along the line 6—6 of FIG. 4.
Figure 7:
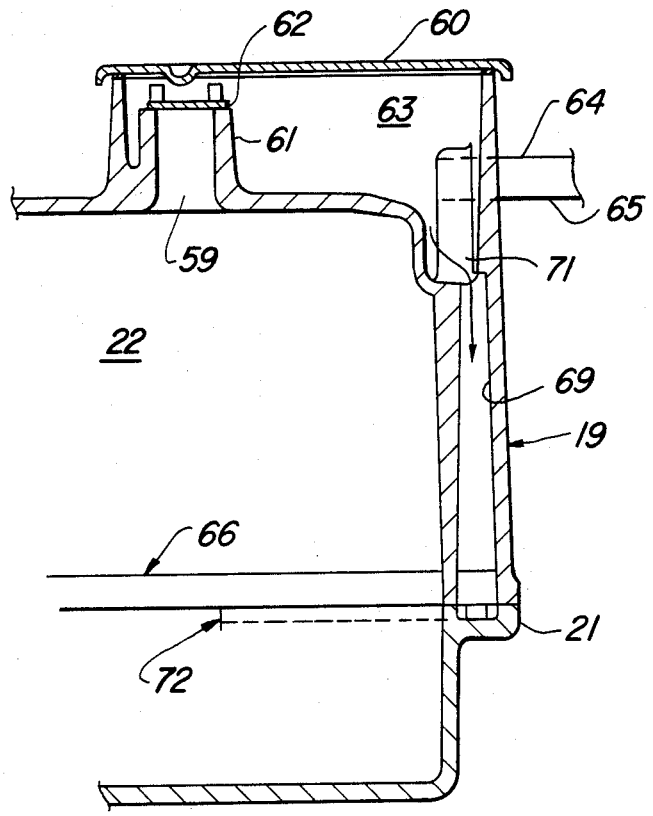
FIG. 7 is a cross sectional view taken along the line 7—7 of FIG. 6.

The engine 11 is provided with a crankcase ventilating system where by blow by gases and ventilating gases for the crankcase are delivered back to the engine induction system for burning by the engine during its operation so as to reduce the emission of unwanted hydrocarbons to the atmosphere. This crankcase ventilating system is best shown in FIGS. 5 through 7 and includes a crankcase ventilating gas inlet opening, indicated 59 which is formed in an upper wall of the crankcase 19 by means of an integral opening. A boss 61 extends upwardly from the opening 19 and a separator plate 62 extends across the gas inlet opening 59 at the upper end of the boss 61 so as to provide some separation function and to limit the passage of any solid particles into the crankcase ventilating system. The inlet 59 communicates with a recirculating crankcase gas conduit means including a chamber 63 that is formed integrally in the upper wall of the crankcase 19. The chamber 63 is closed by means of a plate 60 that is affixed in a suitable manner to the upper end of the crankcase 19. As may be seen FIG. 6, the inlet opening 59 and chamber 63 define a generally arcuate configuration that extends along the peripheral edge of the crankcase 19. A gas discharge fitting 64 is connected to the crankcase 19 and communicates with the chamber 63 for receiving the crankcase ventilating gases and conveying them through an external conduit 65 to the air cleaner 36.

It should be noted that the crankcase ventilating gas inlet opening 59 is disposed above the normal oil service level in the crankcase, which level is indicated by the line 66. It should also be noted from FIG. 6, that when the lawn mower 12 is laid on either one side or the other, the oil level will move to that indicated by either the lines 67 or 68 due to the displaced orientation of the lawn mower and associated engine 11. However, in all three of these positions (normal or tilted to either side) the oil level is below the crankcase gas inlet opening 59 so that oil may never flow into the opening 59.

Because of the splash lubrication of the engine, to be described, and also because of the conditions within the crankcase chamber 22, some lubricant in vapor form may pass through the inlet opening 59 and pass the separator plate 62 into the chamber 63. However, the chamber 63 defines a relatively long circuitous passage way and is at a lower temperature than the interior of the crankcase 22. As a result, lubricant will recondense in this chamber 63.

The condensed lubricant flows through a vertically extending passageway 69 that is formed in the wall of the crankcase 19 from an inlet opening 71 that is positioned at a remote location in the chamber 63 from the gas inlet 59. The passageway 69 is arcuate and extends around the side of the crankcase 19 as shown in FIG. 5 from the inlet opening 71 to a discharge opening 72 that is formed in the interface between the crankcase 19 and the cover plate 21. It should be noted that this discharge opening 72 is disposed so that it will be above the level of the lubricant as indicated again by the lines 67 and 68 in FIG. 5 when the engine 11 and lawn mower 12 are tilted to either side. As a result, there is the assurance that lubricant cannot flow from the crankcase chamber 22 back through the lubricant return conduit 69 when the engine and lawn mower are tilted on their side. As a result, this is further assurance that lubricant cannot enter the induction system when the lawn mower is tiled on its side for servicing. Therefore, a very simple passage arrangement is provided within the main castings of the system in liquid form. Furthermore, the passage ways require no external plumbing and are clear of interference with the running components of the engine.

As has been noted, the engine 11 is provided with a splash lubricating system. This system includes an oil slinger, indicated generally by the reference numeral 73 and shown in FIGS. 5 and 8. The oil slinger 73 has a hub portion 74 that is journaled on a shaft 75 that is fixed to the cover plate 21 by means of a supporting bracket 76. The shaft 75 defines an axis of rotation for the oil slinger 73 which is neither vertical nor horizontal. That is, the axis of rotation of the oil slinger 73 is at an angle to both the horizontal and vertical so as to direct the oil in the appropriate and desired direction, as well now be described.

The oil slinger 73 is formed with a set of gear teeth 77 that are in mesh with the camshaft timing gear 57 so as to drive the oil slinger 73 upon rotation with the camshaft 44. The oil slinger is also formed with a plurality of impellers portion 78 which are at least partially submerged in the lubricant below the lubricant level 66 during operation of the engine. As a result, oil will be thrown upwardly by the impellers 78 in a direction as shown by the arrows 79 in FIG. 8 toward a well 81 formed in the upper wall of the crankcase 19 around the upper camshaft bearing 46. As a result, oil will be thrown upwardly by the impellers and this oil will run downwardly and be thrown outwardly by the cam lobes so as to lubricate the crankshaft. As a result, a fine mist of oil will be maintained in the crankcase chamber 22 that will insure good and adequate lubrication for the running components of the engine.

A fuel tank, indicated generally by the reference numeral 82 is supported by the engine to the rear of the crankcase 19 in the normal orientation of the engine. Fuel is supplied from the fuel tank 82 to the carburetor 34 through a suitable supply line.

Figure 2:
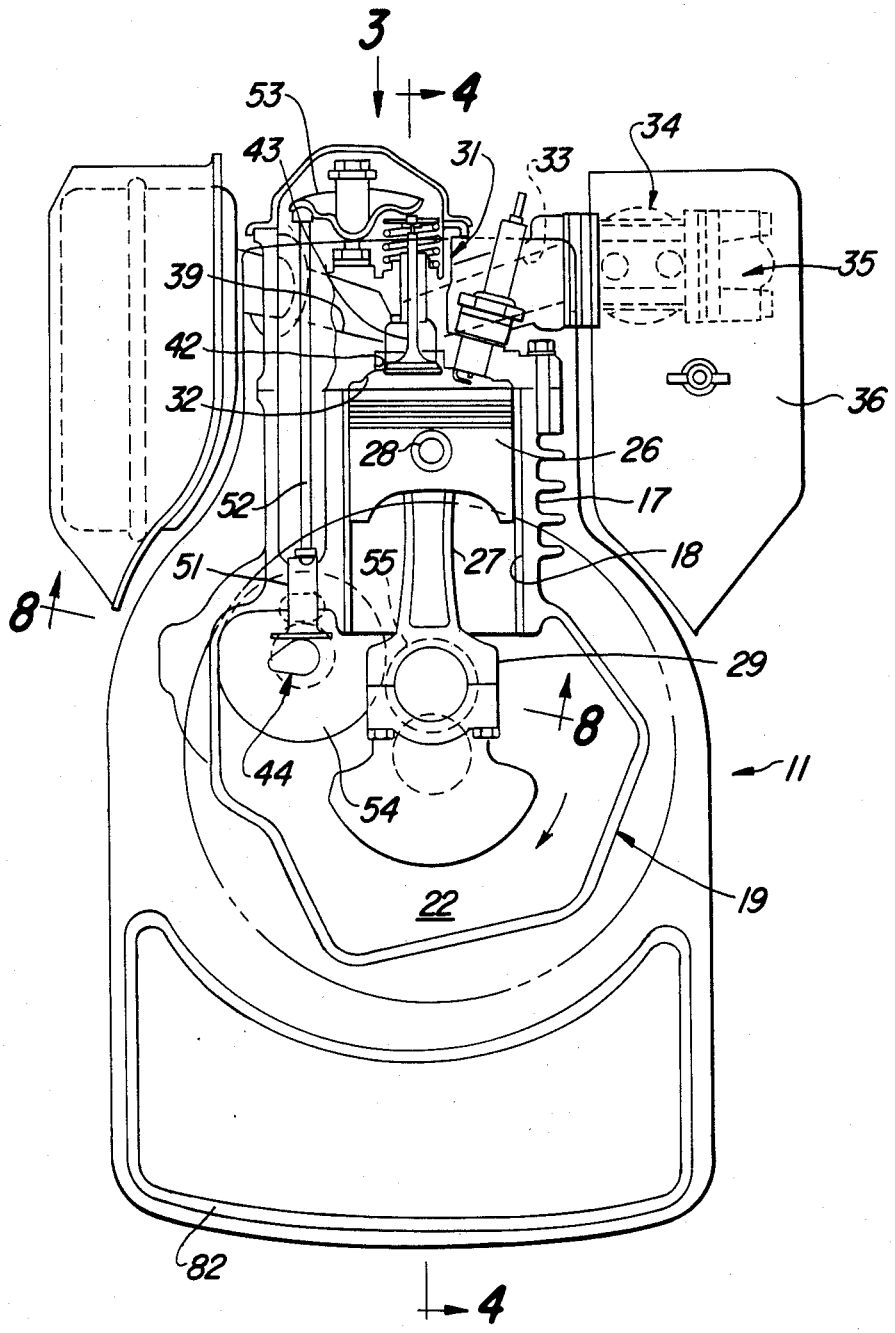
FIG. 2 is a top plan view of the engine, with a portion broken away.
Figure 3:
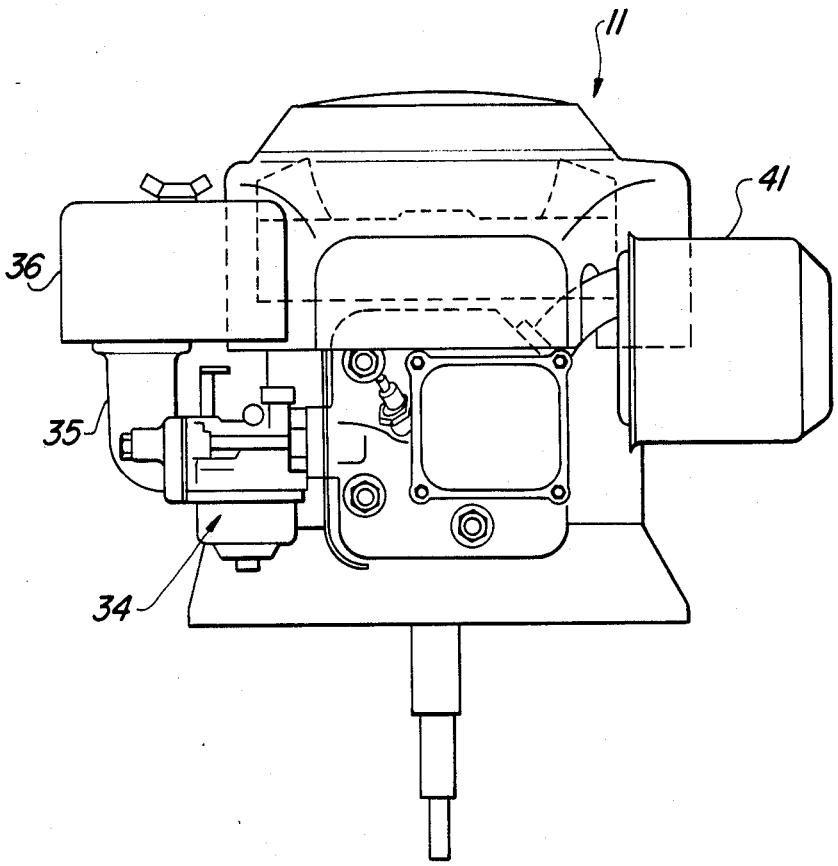
FIG. 3 is a front elevation view of the engine looking in the direction of the arrow 3 in FIG. 2.
Figure 4:
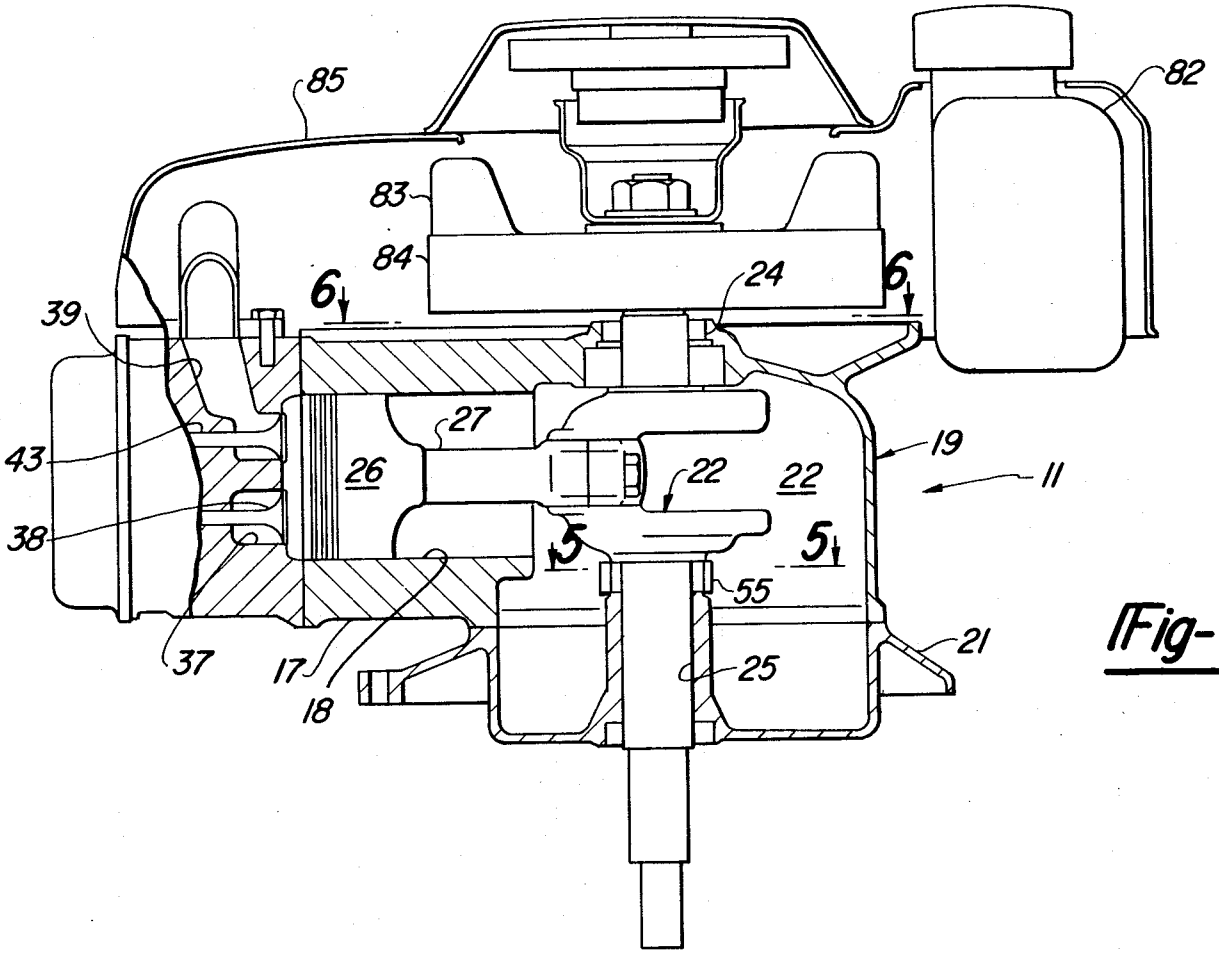
FIG. 4 is a cross sectional view taken along the line 4—4 of FIG. 2.

The engine is also air cooled and for this purpose the cylinder 17 is provided with cooling fins as may be seen in FIG. 2. A source of cool air is provided by means of an implurality of impeller fan blades 83 that are formed on a flywheel 84 that is fixed to the upper end of the crankshaft 23 above the crankcase 19. A cooling air shroud 85 is fixed to the upper end of the engine and overlies the cylinder 17 and crankcase 19 as well as enclosing the flywheel 84 and its impeller blades 83. An air inlet opening (not shown) is provided in proximity to the air cleaner so that cool outside air may be drawn from around the air cleaner into the shroud for 85. This air is circulated by the fan 83 across the cylinder 17 crankcase 19 and is discharged through a discharge opening in proximity to the muffler 41. As a result, there will be cooling of the muffler 41 and good cooling air flow around the engine to assist in its cooling.

It should be readily apparent from the foregoing description that a very compact yet highly effective engine configuration has been provided. In addition, the arrangement is such that a good system for lubricating the engine is incorporated and the crankcase blow by gases will be discharged to the atmosphere only after they have passed back through the induction system and combustion chamber so as to reduce the amount of unburned hydrocarbons discharged to the atmosphere. Furthermore, the arrangement is such that lubricant cannot flow into the induction system even if the lawn mower or associated implement is turned on its side for servicing. Although, an embodiment of the invention has been illustrated and described, various changes and modifications may be made without departing from the spirit and scope of the invention, as defined by the impended claims.

We claim:

1. In a lubricating system for an internal combustion engine adapted to power an implement such as a lawn mower operated normally in an erect position and tiltable on its side to a service position, said engine comprising a crankcase defining a crankcase chamber, an engine output shaft journaled within said crankcase for rotation about a generally vertically extending axis when the associated implement is in its normal erect operating position and movable toward a generally horizontal position when said implement is tilted on its side to its service position, said crankcase defining a reservoir for engine lubriicant, an induction system for providing combustion air for said engine, said induction system including an air inlet device for receiving atmospheric air for delivery to said engine, and a crankcase ventilating system for said crankcase chamber comprising a crankcase air inlet for receiving gases from said crankcase and conduit means extending from said crankcase air inlet to said air inlet device for recirculating crankcase gases to said engine through said induction system, said crankcase air inlet lying above the level of lubricant in said crankcase regardless of whether the associated implement is in its normal erect position or on its side in its service position for precluding lubricant from flowing into said air inlet device.

2. In a lubricating system as set forth in claim 1 wherein the induction system air inlet device comprises an air cleaner.

3. In a lubricating system as set forth in claim 1 wherein the crankcase air inlet comprises an opening formed in an upper wall of the engine crankcase.

4. In a lubricating system as set forth in claim 3 wherein the conduit means comprises a chamber formed integrally within the crankcase upper wall.

5. In a lubricating system as set forth in claim 4 wherein the conduit means further includes an external conduit extending from the crankcase chamber to the air cleaner.

6. In a lubricating system as set forth in claim 1 further including a lubricant return conduit extending from the conduit means back to the crankcase for returning separated lubricant from the recycled crankcase gases back to said crankcase, said lubricant return conduit having a lubricant inlet opening communicating with said conduit means and a lubricant return opening communicating with said crankcase, at least one of said openings being disposed above the level of lubricant in said crankcase when said implement is in its service position.

7. In a lubricating system as set forth in claim 6 wherein the lubricant return opening is disposed above the level of lubricant in the crankcase when the implement is in its service position.

8. In a lubricating system as set forth in claim 7 wherein the lubricant return conduit is formed integrally with the wall of the crankcase.

9. In a lubricating system as set forth in claim 1 further including a camshaft journaled for rotation within the crankcase about a vertically disposed axis, means for driving said camshaft from said crankshaft, an oil slinger rotatable about an axis disposed at an angle to both the horizontal and the verical and at least in part submerged in the lubricant in said crankcase, and means for driving said oil slinger from said camshaft, said oil slinger axis being disposed for directing lubricant thrown by said slinger toward the upper end of said camshaft.

10. In a lubricating system as set forth in claim 9 further including timing gear means on the crankshaft and on the camshaft for driving the camshaft from the crankshaft, said oil slinger being driven by said camshaft timing gear.

11. In a lubricating system as set forth in claim 9 further including timing gear means on the crankshaft and on the camshaft for driving the camshaft from the crankshaft, said oil slinger being driven by said camshaft timing gear.

12. In a lubricating system as set forth in claim 11 wherein the crankcase air inlet comprises an opening formed in an upper wall of the engine crankcase.

13. In a lubricating system as set forth in claim 12 wherein the conduit means comprises a chamber formed integrally within the crankcase upper wall.

14. In a lubricating system as set forth in claim 13 wherein the conduit means further includes an external conduit extending from the crankcase chamber to the air cleaner.

15. In a lubricating system as set forth in claim 14 further including a lubricant return conduit extending from the conduit means back to the crankcase for returning separated lubricant from the recycled crankcase gases back to said crankcase, said lubricant return conduit having a lubricant inlet opening communicating with said conduit means and a lubricant return opening communicating with said crankcase, at least one of said openings being disposed above the level of lubricant in said crankcase when said implement is in its service position.

16. In a lubricating system as set forth in claim 15 wherein the lubricant return opening is disposed above the level of lubricant in the crankcase when the implement is in its service position.

17. In a lubricating system as set forth in claim 16 wherein the lubricant return conduit is formed integrally with the wall of the crankcase.

18. In a lubricating system for an internal combustion engine adapted to power an implement such as a lawn mower operated normally in an erect position and tiltable on its side to a service position, said engine comprising a crankcase defining a crankcase chamber, an engine output shaft journaled within said crankcase for rotation about a generally vertically extending axis when the associated implement is in its normal erect operating position and movable toward a generally horizontal position when said implement is tilted on its side to its service position, said crankcase defining a reservoir for engine lubricant, an induction system for providing combustion air for said engine, said induction system including an air inlet device for receiving atmospheric air for delivery to said engine, a crankcase ventilating system for said crankcase chamber comprising a crankcase air inlet for receiving gases from said crankcase and conduit means extending from said crankcase air inlet to said air inlet device for recirculating crankcase gases to said engine through said induction system, and a lubricant return conduit extending from said conduit means back to said crankcase for returning separated lubricant from the recycled crankcase gases back to said crankcase, said lubricant return conduit having a lubricant inlet opening communicating with said conduit means and a lubricant return opening communicating with said crankcase, at least one of said openings being disposed above the level of lubricant in said crankcase when said implement is in its service position.

19. In a lubricating system as set forth in claim 18 wherein the one opening comprises the lubricant return opening.

20. In a lubricating system as set forth in claim 19 wherein the lubricant return conduit is formed integrally with the crankcase.

21. In a lubricating system as set forth in claim 20 wherein the crankcase air inlet comprises an opening formed in an upper wall of the engine crankcase.

22. In a lubricating system as set forth in claim 21 wherein the conduit means comprises a chamber formed integrally within the crankcase upper wall.

23. In a lubricating system as set forth in claim 22 wherein the conduit means further includes an external conduit extending from the crankcase chamber to the air cleaner.

24. In a lubricating system for an internal combustion engine adapted to power an implement such as a lawn mower operated normally in an erect position and tiltable on its side to a service position, said engine comprising a crankcase defining a crankcase chamber, an engine output shaft journaled within said crankcase for rotation about a generally vertically extending axis when the associated implement is in its normal erect operating position and movable toward a generally horizontal position when said implement is tilted on its side to its service position, said crankcase defining a reservoir for engine lubricant, an induction system for providing combustion air for said engine, said induction system including an air inlet device for receiving atmospheric air for delivery to said engine, a crankcase ventilating system for said crankcase chamber comprising a crankcase air inlet for receiving gases from said crankcase and conduit means extending from said crankcase air inlet to said air inlet device for recirculating crankcase gases to said engine through said induction system, and a lubricant return conduit extending from said conduit means back to said crankcase for returning separated lubricant from the recycled crankcase gases back to said crankcase, said lubricant return conduit having a lubricant inlet opening communicating with said conduit means and a lubricant return opening communicating with said crankcase, said lubricant return conduit being formed in a wall of said engine.

25. In a lubricating system as set forth in claim 24 wherein the lubricant return conduit is formed integrally in the wall of the crankcase.

26. A lubricating system for an internal combustion engine having a generally horizontally disposed cylinder extending from a crankcase, a crankshaft journaled for rotation within said crankcase about a generally vertically extending axis, a camshaft journaled for rotation within said crankcase about a vertically disposed axis, means for driving said camshaft from said crankshaft, an oil slinger rotatable about an axis disposed at an angle to both the horizontal and the vertical and at least in part submerged in the lubricant in said crankcase, and means for driving said oil slinger from said camshaft, said oil slinger axis being disposed for directing lubricant thrown by said slinger toward the upper end of said camshaft.

27. In a lubricating system as set forth claim 26 wherein the means for driving the camshaft from the crankshaft comprises a pair of intermeshing timing gears formed respectively on the camshaft and crankshaft, the oil slinger being driven by gear means intermeshed with the timing gear of the camshaft.

28. In an internal combustion engine of the type for powering an implement with the engine output shaft rotating about a generally vertically disposd axis comprising a cylinder disposed in a generally horizontal plane, an induction system comprised of a carburetor lying on one side of said cylinder for delivering a charge to said cylinder from said one side, an air cleaner disposed above said carburetor for delivering filtered air to said carburetor, an exhaust system including a muffler disposed on a side of said cylinder opposite to said air cleaner for discharging exhaust gases from said cylinder to the atmosphere, a fan chamber disposed of said cylinder and containing a fan driven by said engine, and means defining a flow path through said fan chamber between a cooling air inlet disposed contiguous to said air cleaner and a discharge disposed contiguous to said muffler.

29. In a lubricating system as set forth in claim 28 wherein the fan is formed integrally with a fly wheel of the engine.

* * * * *